US005348029A

United States Patent [19]

Garcia Rodriguez

[11] Patent Number: 5,348,029

[45] Date of Patent: Sep. 20, 1994

[54] NAIL VARNISH APPLICATOR HAVING PINCERS

[76] Inventor: Manuel Garcia Rodriguez, Urbanizacion Jaizkibel, Villa Arit-Alde, Fuenterrabia (Guipuzcoa), Spain, 20280

[21] Appl. No.: 842,877

[22] Filed: Feb. 27, 1992

[30] Foreign Application Priority Data

Mar. 8, 1991 [ES] Spain ..... 9100612

[51] Int. Cl.[5] ..... A45D 29/18

[52] U.S. Cl. ..... 132/74.5; 132/73.5

[58] Field of Search ..... 132/73, 73.5, 73.6, 132/74.5, 75

[56] References Cited

U.S. PATENT DOCUMENTS

| | | | |
|---|---|---|---|
| 2,183,662 | 12/1939 | Warr et al. | 132/74.5 |
| 2,279,520 | 4/1942 | Perillo | 132/74.5 |
| 2,467,570 | 4/1949 | Ward | 132/74.5 |
| 2,771,621 | 11/1956 | Erickson | 132/74.5 |
| 3,292,642 | 12/1966 | Del Vecchio | 132/74.5 |
| 3,730,191 | 5/1973 | Doornbos | 132/73.6 |
| 4,020,856 | 5/1977 | Masterson | 132/74.5 |
| 4,258,734 | 3/1981 | Hehlo | 132/74. |
| 4,319,596 | 3/1982 | Jackson | 132/73.6 |
| 4,964,372 | 10/1990 | Zeenni et al. | 132/74.5 |
| 5,054,503 | 10/1991 | Keller | 132/75 |

FOREIGN PATENT DOCUMENTS

| | | |
|---|---|---|
| 3615701 | 10/1987 | Fed. Rep. of Germany . |
| 1591053 | 6/1970 | France . |
| 2569960 | 5/1986 | France . |
| WO83/03955 | 11/1983 | PCT Int'l Appl. . |

*Primary Examiner*—Gene Mancene
*Assistant Examiner*—Frank A. LaViola
*Attorney, Agent, or Firm*—Darby & Darby

[57] ABSTRACT

The nail varnish applicator comprises a preferably cylindrical body, one of the ends of which is fitted with a dispenser for varnish contained in a reservoir and another end being adapted to receive a finger. A dose of varnish is sent to soak a brush, the spread of the brush being controlled by two pincers which follow the profile of the fingernail of an inserted fingernail to delimit the region to be varnished. The body is wholly closed by doors that are released on inserting the finger. The brush has an arched and resilient back for its ends to follow the edges of pincers that follow the nail contour. The back of the brush can also be made up of various displaceable elements with bristles that partially overlap one another. The brush is covered by a casing, removable by one of rotation and axial displacement. The varnish is applied upon displacement of the nail with respect to the brush, when either element stays in place.

15 Claims, 13 Drawing Sheets

NAIL VARNISH APPLICATOR HAVING PINCERS

OBJECT OF THE INVENTION

The present invention relates, as set forth in the title hereto, to a nail varnish applicator designed as a pocket set to be carried and used easily, the varnish being applied on inserting the fingernail to be varnished through an axial mouth provided to such end in the body thereof. Upon removing the finger, it will already be duly varnished, and the next finger may then be inserted, and so on, the size of the nails being of no consequence.

BACKGROUND TO THE INVENTION

There are currently no nail varnish applicators as such are described herein, since only containers or flasks containing the varnish are used, their mouth being sealed by means of a cap having a brush for manual application, this requiring great care for the result to be pleasing.

This current operation involving hand varnishing also requires, in addition to the necessary ability, that the hand or finger with the nail to be varnished to stay still whilst being varnished, and thus the person that carries out this operation, normally the user, must be very calm. This current operation cannot be carried out in places in motion, for instance a moving vehicle.

The only background cited in a preliminary search report drawn up by the European Patent Office at the applicants' request in the subject hereof are patents of invention nos. WO 83/03955, U.S. Pat. Nos. 4,319,596, 3,730,191, DE 3615701, PR 2569960 and FR 1591053.

The first two solely relate to nail varnish remover devices in which a rotary mechanical device with bristles that are dipped in or soaked with the varnish removing liquid is directly operated.

U.S. Pat. No. 3,730,191 relates to an appliance that sprays the varnish at a distance on the nail protected with a mask that is not directly related to the applicator subject of the invention either.

DE P.I. 3615701 shows a spray applicator, similar to the above, which sprays lacquer against a distant membrane which has a hole where the nail is placed and thus painted.

A layout similar to the above two patents in FR 2569960, provided with a vaporizer having a deformable mask at its outlet which can adapt to the nail which is thus soaked with varnish.

Finally, French P.I. 1591053 shows a cosmetics distributor apparatus in a box containing an electric motor to turn, by reducer wheels, a spread cover for the cosmetic product to be applied upon the relevant epidermis.

In order to overcome the disadvantages set forth above and to achieve the advantages laid down herein, the nail varnish applicator subject of the invention generally consists of a preferably cylindrical body, one of its ends defining the mouth to fit the dispenser for the varnish contained in a reservoir, the other end being the mouth for the fingernail to be varnished, this operation taking place inside the body, and can be followed by means of a viewer provided at such area.

The varnish dispenser sends a dose of product to soak a brush used to varnish the nail surface. The bristles in this brush are preferably set radially for the free ends thereof to be arched. The back from which the bristles project is flexible for the size of the arch to vary and adapt to the nail contour. Pincers associated thereto are used to follow the profile of the nail to be varnished, the nail moving lengthwise in respect of the brush, with a relative displacement that can be attained either by placing the nail in a fixed position and moving the brush by hand, or holding the latter in place and varnishing on introducing the finger through the mouth of the body of the device. A second coat is provided on removing the finger to enhance the varnish.

The end of the body through which the fingernail to be varnished is introduced is preferably closed by a pair of hinged doors that are kept closed by means of a locking device or catch that is released on inserting the finger. It comprises a double element push-button, one of which elements is moved out of the way by the nail, while the other one is still pressed and supports and guides the finger, for this second element is provided with an axial extension that is preferably telescopically guided in a rod that axially and concentrically runs along the body of the device, acting as a pumping mechanism for the varnish dispenser. The closure device can also be defined by a circular hinged cap, collapsible towards the inside of the body and the periphery of which closes on the curved elements that define the pincers that separate and adjust to the finger when the same moves forward, and vice versa.

The varnish reservoir must be shaken before being used, as is known, so that the steel balls inside the same move for the varnish particles to be evenly mixed, for they would be deposited on the bottom.

The varnishing brush is protected by a casing that is released on inserting the finger. This casing can be removed by rotation by means of a device having a helical slot and a follower stub, or else be axially displaced towards the inside of the body, also when inserting the finger, in both cases overcoming the recoil spring action in respect of the original position.

It is very important for the amount of product dispensed to be properly metered, for not too much product must be provided.

The varnish reservoir, provided with the dispenser, can actually comprise a container with the neck including the chamber for access of the product pumped when the pumping device rod moves forward, which metered amount can be led by an internal conduit in the brush handle to soak the bristles as varnishing takes place. The varnish can also be ejected directly to the outside of the bristles before the brush moves in respect of the nail.

The varnish reservoir can also be conventional and disposable since it is attached to an adaptor, which can then as a whole be plugged into and duly held at the lower mouth of the body, thereby for different varnish reservoirs, known per se, to be used with the same device.

In the event of the brush being displaceable while the nail stays in place in its housing inside the body, the brush is stiffened to a dispenser-push-button handle that slides along a longitudinal slot in the body. The nail is duly located on the pincers limiting its contour and the finger stays in place by action of a sloped sluice, fitted with a side actuation spring.

The existence of vents for quick drying, located at the entrance to the body, has also been provided for.

The nail varnish applicator can be designed so that when the product is used up, it can either be thrown out or be recharged.

An applicator exactly as above can also be used, but, instead of varnish, having a cleaning product, such as acetone or the like, to clean the nail before proceeding to varnish the same.

In order to contribute to the understanding of the characteristics of this invention, a set of drawings is attached to the specification with diagrams that, while purely illustrative and not fully comprehensive, show the object of the invention, as follows:

DESCRIPTION OF THE PREFERRED EMBODIMENT

Using the numbering of the figures, we can see that in connection particularly with FIGS. 1 through to 10, same show a wholly automatic nail varnish applicator, for varnishing takes place as the finger is inserted through the mouth of the device's body, provisionally closed by a cap, as we shall see hereinafter.

It comprises a cylindrical surrounding body 1 the lower mouth of which is fitted with the container 2, or varnish reservoir. The opposite mouth of the cylindrical body 1 defines the inlet for the finger 3 that is to have its nail 4 varnished, which operation takes place by inserting and then removing the finger 3.

Figure 3:
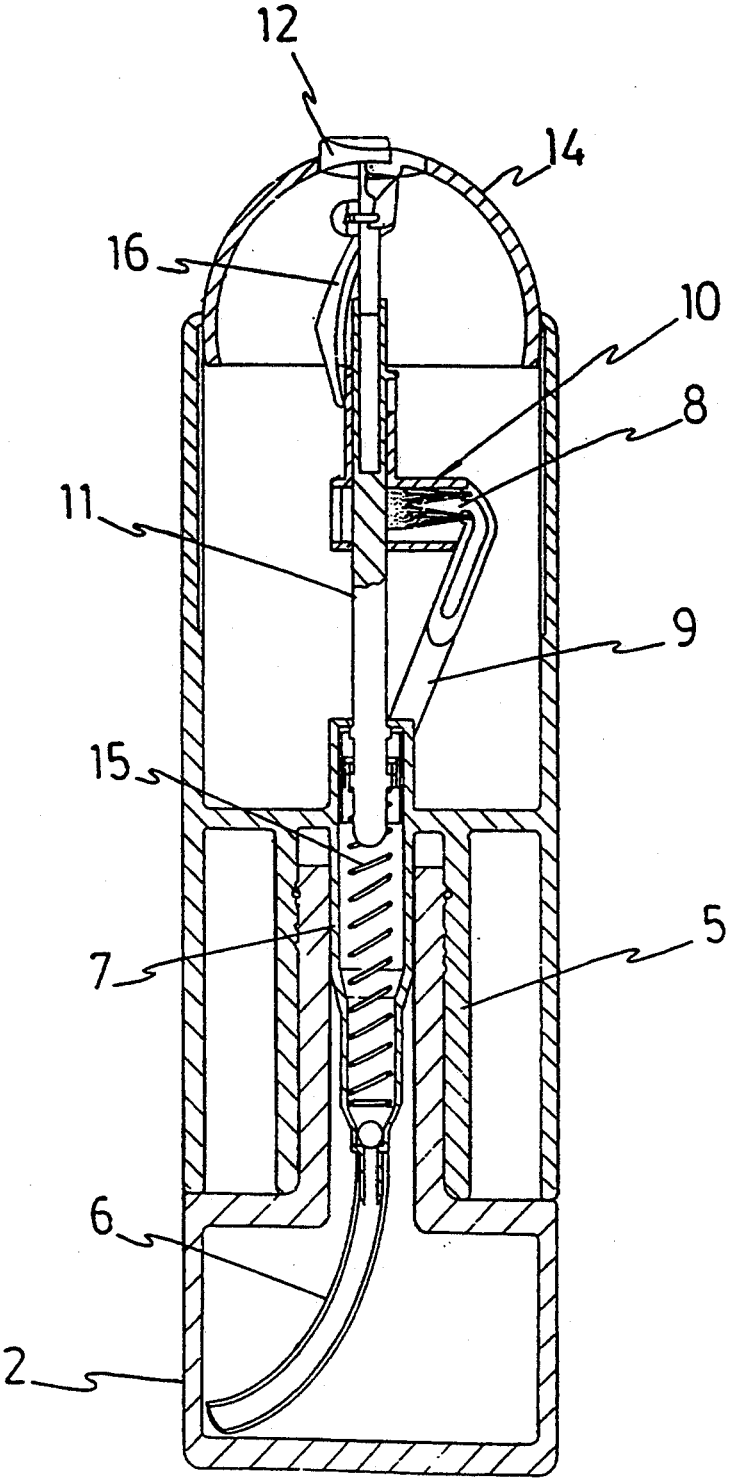
FIG. 3. Is a longitudinal section of what is shown in the above figures.

The varnish reservoir 2, as shown diagrammatically in FIG. 3, has its neck perfectly fixed, for instance screwed, to the cylindrical neck, being inserted inside the nozzle 6 reservoir 2, which nozzle is in turn fixed to the varnish pumping device 7. This pumping device 7 will soak the brush 8 when the varnish goes through the tubular conduit 9 defined by the support handle thereof.

The brush 8 has its bristles protected by a casing 10 (see FIGS. 1 to 3) that is supported by the axial rod 11 and can be removed when appropriate to allow the nail to be varnished.

Figure 1:
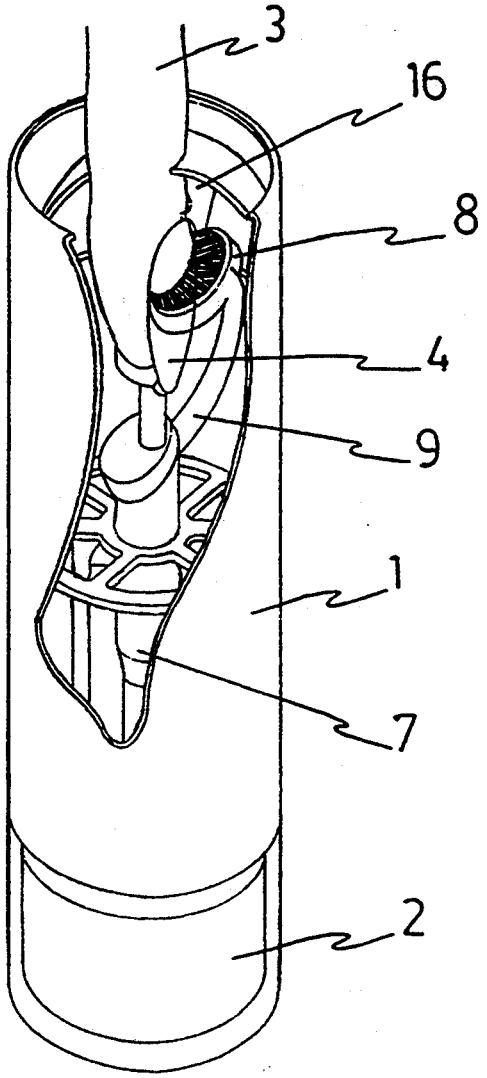
FIG. 1. Is a perspective view, with a portion cut away, of the nail varnish applicator subject hereof.
Figure 2:
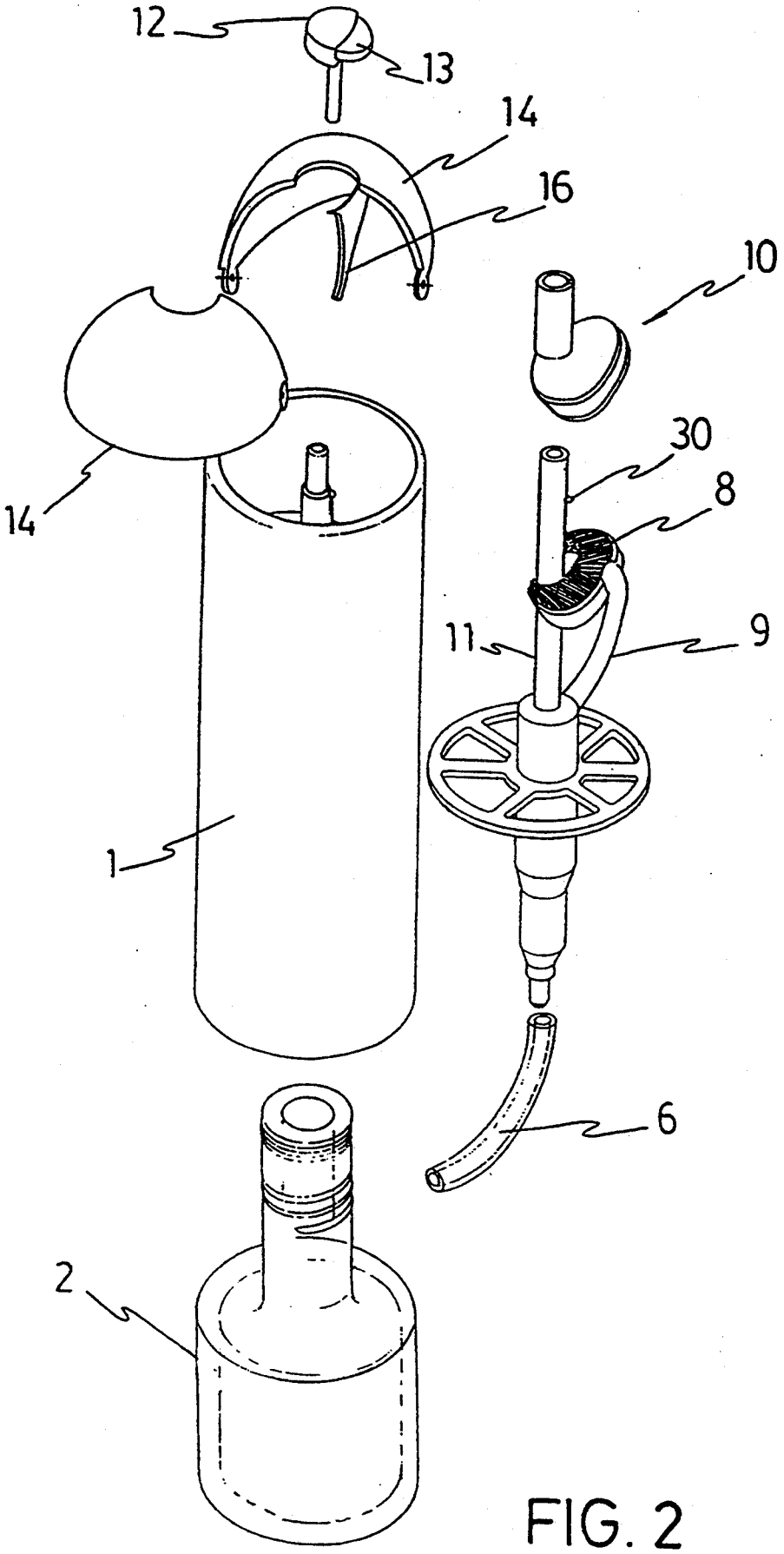
FIG. 2. Is a view of the constituent parts of FIG. 1.

The brush will be soaked with the suitable dose when the finger 3 is inserted and the push-button 12 is finally displaced, once the actual nail 4 has pushed against the hinged element 13 that forms part of the push-button, folding of which releases the system that locks the doors 14, such forming a spherical bush in this embodiment, shown in FIGS. 1 to 3 to which we are presently referring.

The push-button 12 causes axial displacement of the rod 11 provided in the pumping mechanism and fitted with the spring 15.

The back of the brush 8 is arched and made of a resilient material in order for its curvature to be gradually altered to adjust to the size of the nail to be varnished, this taking place with the assistance of pincers 16, right and left, the edges of which act as cam profiles that follow the contour of the nail as the finger inserted gradually moves forward. The ends of the arched back of the brush 8 follow this profile, as is clearly shown in FIG. 7.

The applicator brush is radially and tangentially arranged clamped to the rod 11. The brush is soaked when the pumping device rod 11 is inserted, on extracting therefrom the dose that was previously taken in and contained in the dispenser 7 chamber, the varnish being conveniently guided through the brush handle 9.

With this layout, the device would therefore work as follows:

Upon axial insertion of the finger 3 whose nail 4 is to be varnished, displacing the push-button 12, once the actuator element 13 is displaced to allow the doors 14 to open, the same close upon the finger as this latter continues to move forward inside the device body. The two pincers 16 following the nail contour allow the brush soaked in varnish to sweep the desired nail 4 surface, varnishing taking place by slight pressure, the casing protecting the brush also being released as insertion begins, release thereof being attained by rotation about the shaft rod 11. Upon release of the brush 8 bristles, the nail slides brushing against the same, to be covered in the varnish. Varnishing is very precise, for the lower brush limits adapt to the size of the nail, due to the follower elements or pincers 16 which act as a pattern in order not to go beyond the varnishing limits. Upon releasing the pressure exerted by the finger, in other words, removing the latter, the brush 8 sweeps over again. This same procedure is then repeated with another finger, and so on.

When all the nails have been varnished, the doors 14 are closed by hand, so that they are tightly sealed, joining the same to the locking device that, as aforesaid, is released on inserting a finger after the element 13, that is part of the push-button 12, is moved out of the way.

Figure 4:
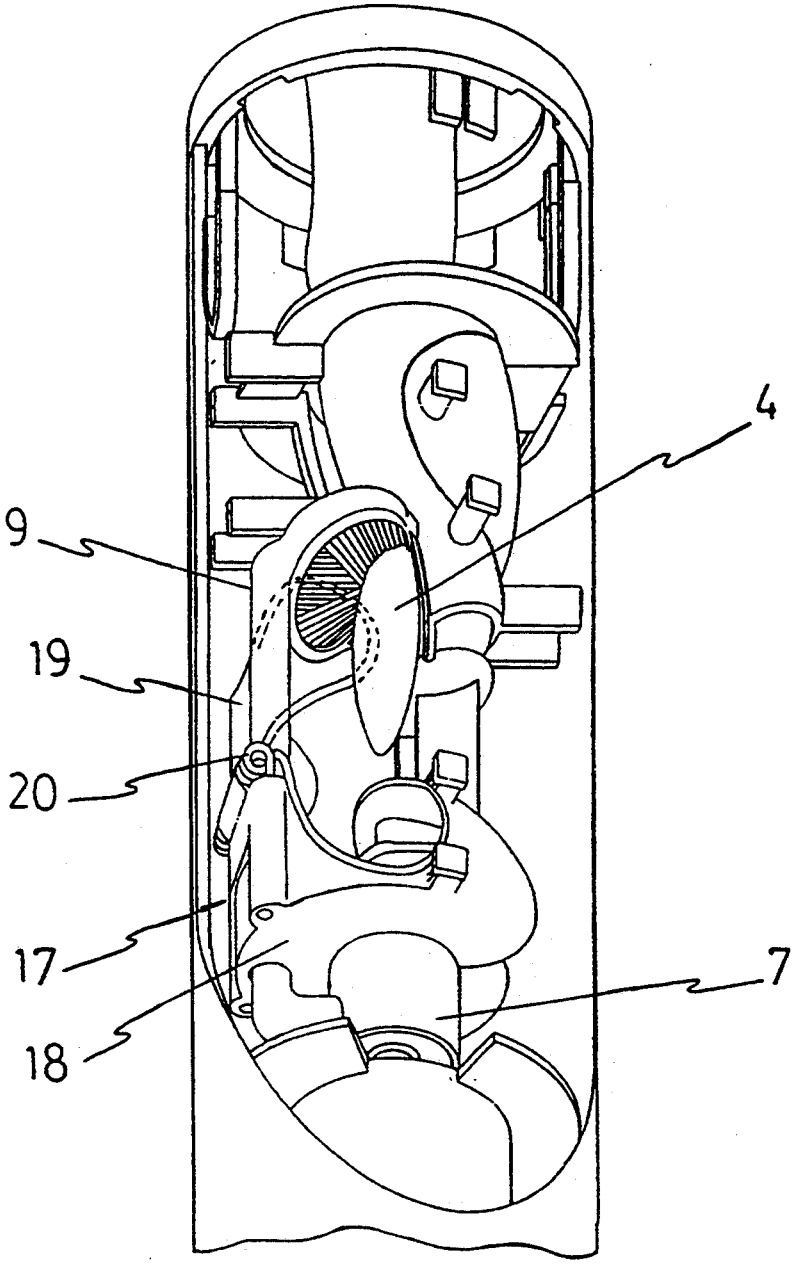
FIG. 4. Is a partial cross-split perspective view, showing the inside of the applicator body, when the varnish applicator brush is released from its protective casing.
Figure 5:
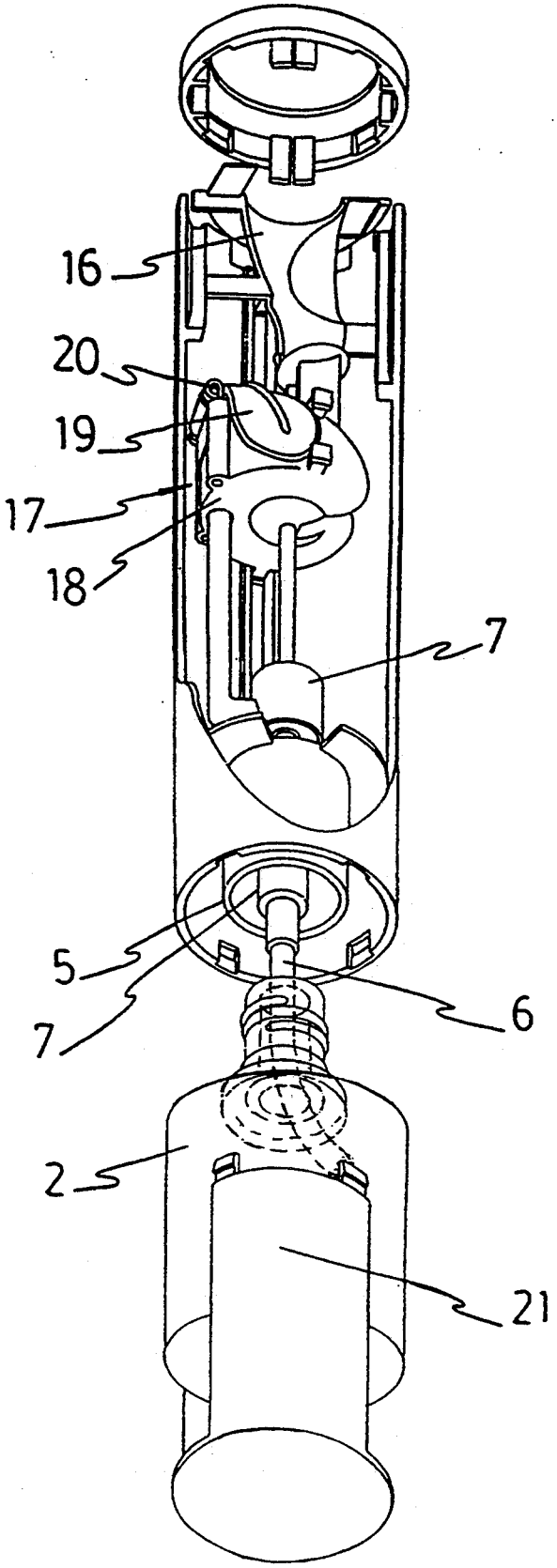
FIG. 5. Is a view similar to FIG. 3, with the varnish applicator brush fully enclosed in its casing.

FIGS. 4 and 5 show another embodiment of the brush casing, in this case numbered 17, which can be displaced axially on inserting the finger.

FIG. 5 clearly shows that the case 17 comprises a lower jacket and a top cover 19 that is hinged to the cross shaft that actually comprises a spring 20 through which such door 20 is kept perfectly closed.

When the finger is inserted, the casing 18 is lowered perfectly guided and the cap 19 opens gradually as the brush 8 is fixed, staying open on resting upon the actual handle 9. On removing the finger, the body 18 of the casing 17 rises and when the cover 19 reaches the end of the handle 9, it is closed.

Figure 6:
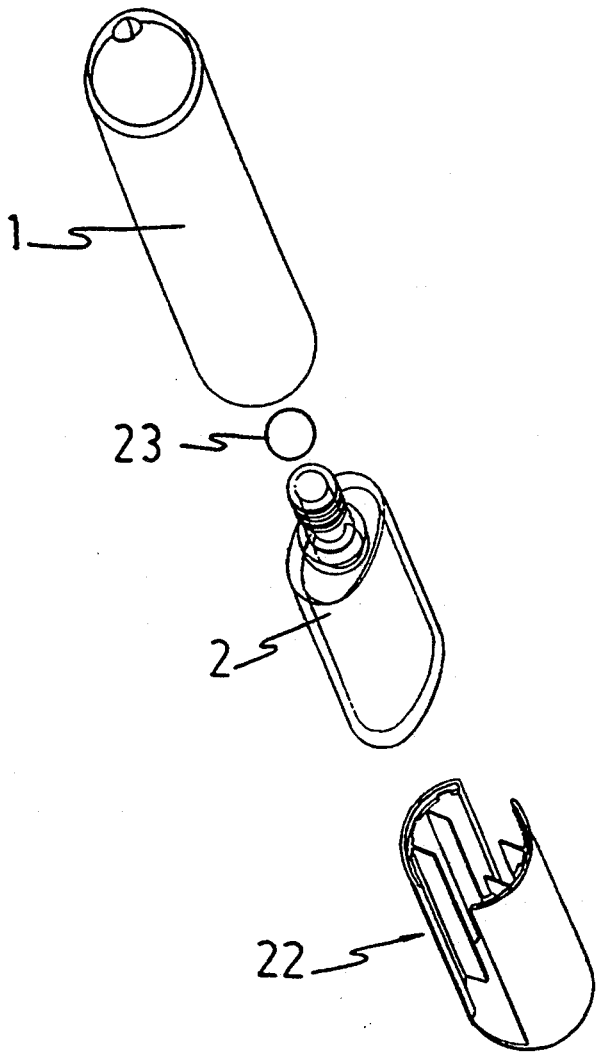
FIG. 6. Is an exploded perspective view of the nail varnish applicator, with a conventional and disposable varnish reservoir, connected to the body through an adaptor.

With reference to FIG. 6, we can see that the varnish reservoir 2 is fixed to the device's body 1 through the support 21 (FIG. 5), and is replaceable since it is fitted to an adaptor 22, and may thus be wholly conventional and its dimensions different to those required for adaptation thereof to the body 1. Once the adaptor element 22 has been fitted, the assembly can be perfectly held at the lower mouth of the body, and thus different varnish reservoirs can be used. This FIG. 6 is numbered 23 with the O-ring gasket that provides a perfectly tight seal.

Figure 7:
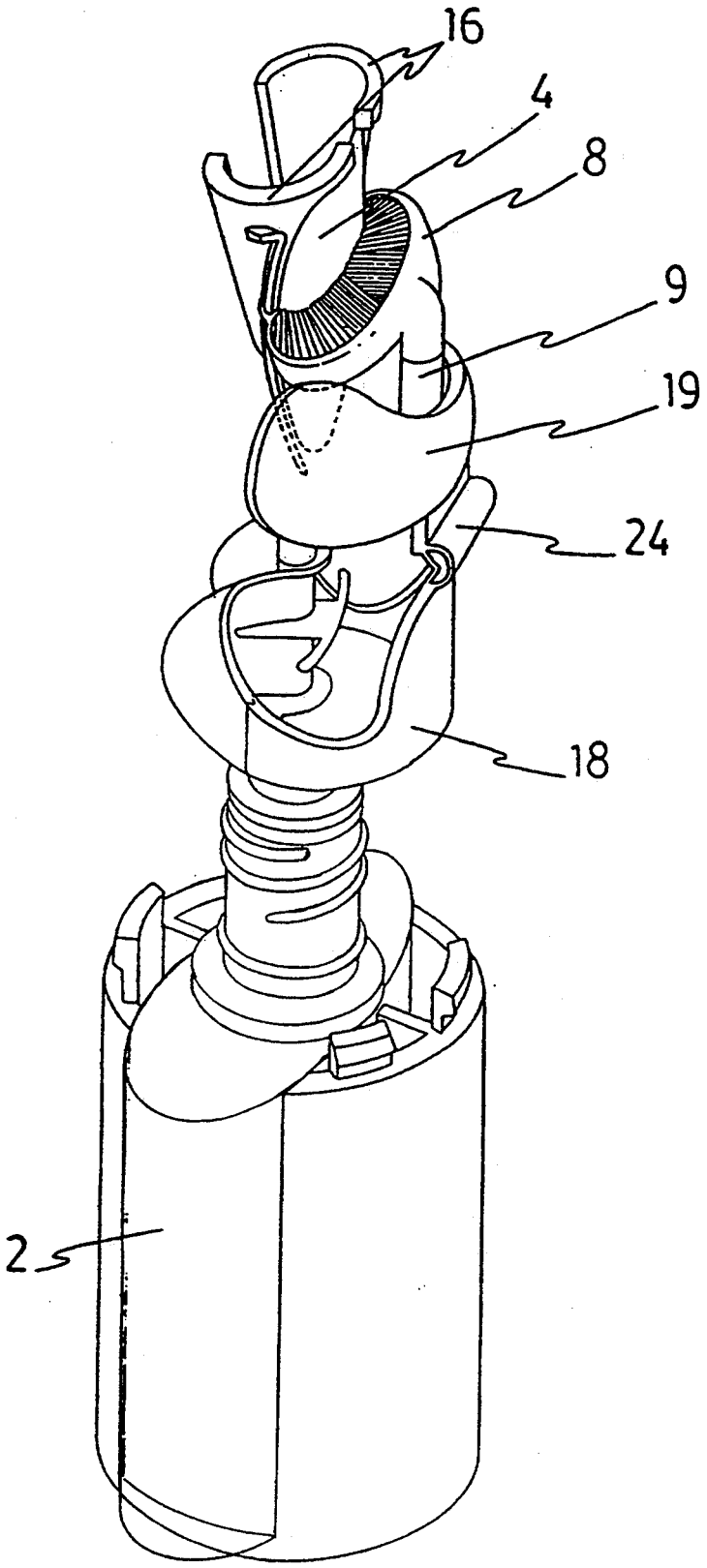
FIG. 7. Is a diagrammatic view showing a perspective of the elements inside the body surrounding the nail varnish applicator, likewise showing the varnish reservoir.

FIG. 7 clearly shows how the brush 8 bristles adapt to the edges of the pincers 16 and therefore to the profile of nail 4. In this case, the cover 19 closing the brush casing is hinged to the lower body 18 through a hinge element that also acts as a spring in order for closure to be perfect, this resilient hinge element being generally numbered 24, and manufactured in the same process to inject the material making up the casing.

Figure 8:
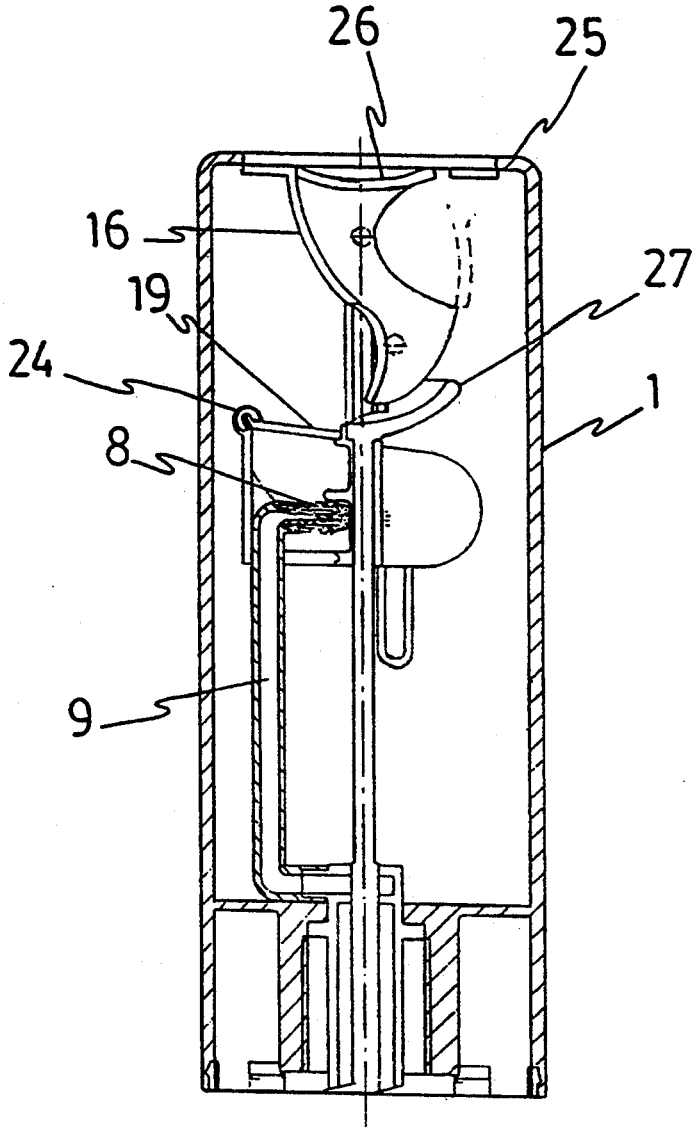
FIGS. 8, 9 and 10. Are, respectively, longitudinal elevation, side elevation and upper plan views of the top of the device, showing the way the body cap is closed, the arrangement being largely flat.
Figure 9:
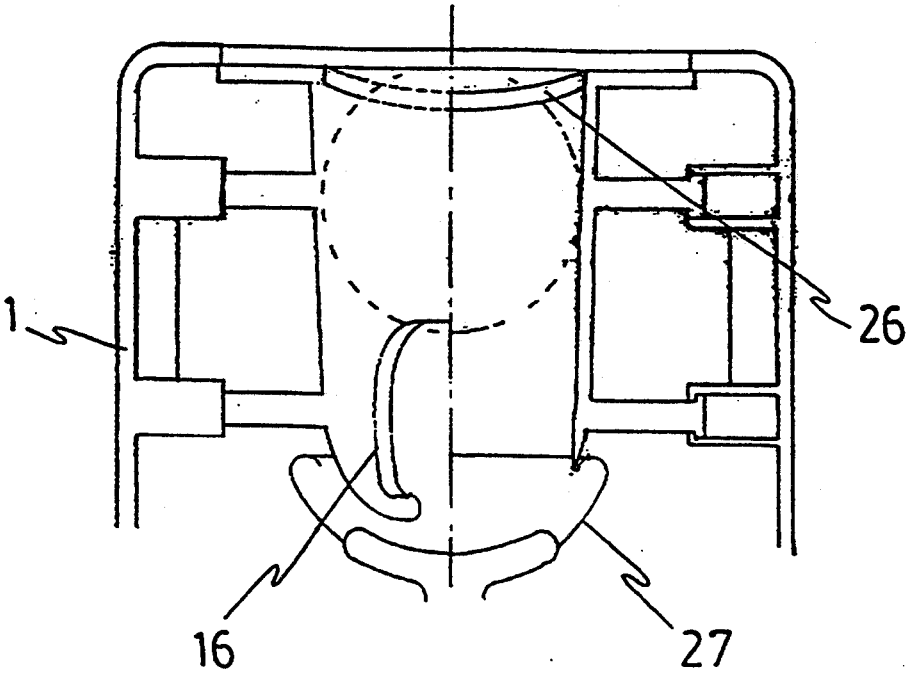
Figure 10:
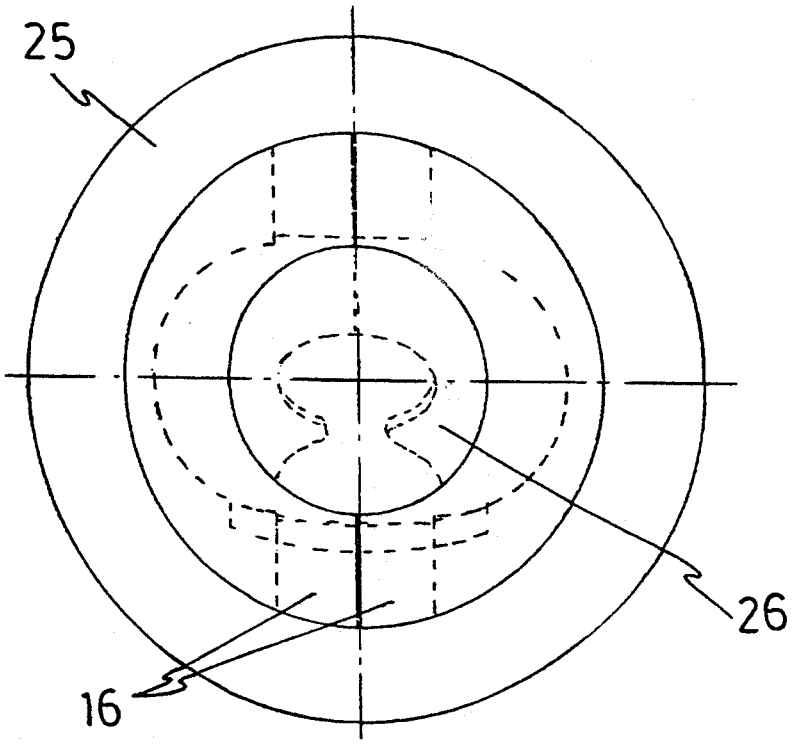

FIGS. 8 through to 10 show how the body 1 top cap is closed, in an embodiment that is simpler than that of FIG. 2, the top mouth of the body 1 being almost flat. The same body 1 has an annular tab 25 to which the top edges of the pincers 16 adjust (see FIG. 7), the disk-shaped cap 26 itself closing the annular gap formed therebetween. The closed position of such cap 26 is shown in the solid line of FIGS. 8 through to 10, the dotted line showing the open position. The door 26 is fitted with a spring that keeps it closed, which is not shown in these figures for the sake of clarity. Upon inserting the finger and opening the door 26, access to the inclined push-button 27 surface is possible, moving down so that the nail, duly flanked between the pincers 16, can be varnished since the brush casing cover 19 has been removed.

Furthermore, as shown in the relevant figures, in order for the brush 8 to sweep over all of the nail surface, and therefore for the arch defined by the edges of the bristles thereof to vary its curvature, as aforesaid, such back is resilient, thereby to be opened and closed to adapt to the nail contour. This is also achieved in view of the fact that the bristles are arranged radially rather than in a plane, projecting from different parts or elements that are displaceable among one another, thereby to increase the length of the back of the brush. The bristles can thus have end portions that overlap slightly to a greater or lesser extent for the length of the active edge to correspond with the size of a nail in each position of insertion of the finger.

Figure 11:
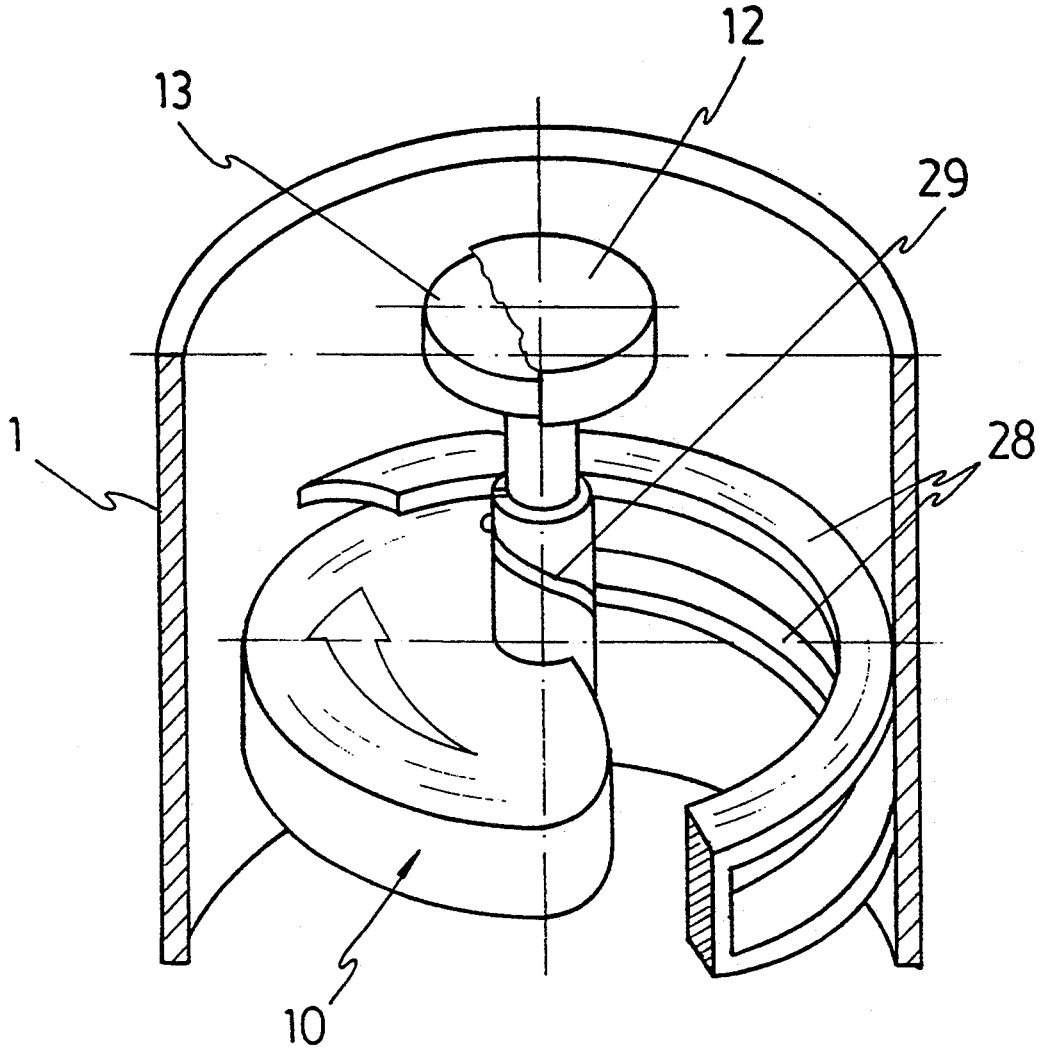
FIG. 11. Is a perspective cross-split view showing how the varnish applicator brush casing is mounted, which can be removed by a 180 degrees rotation.

FIG. 11 shows more clearly how the brush casing 10 is removed to allow the nail 4 to be varnished. In this case, on rotating the casing 10, it is located between the guides 28 that take up a diametrically opposed position, such 180 degree rotation taking place due to a helical slot 29 wherein plays a stub 30 (FIG. 2).

Figure 12:
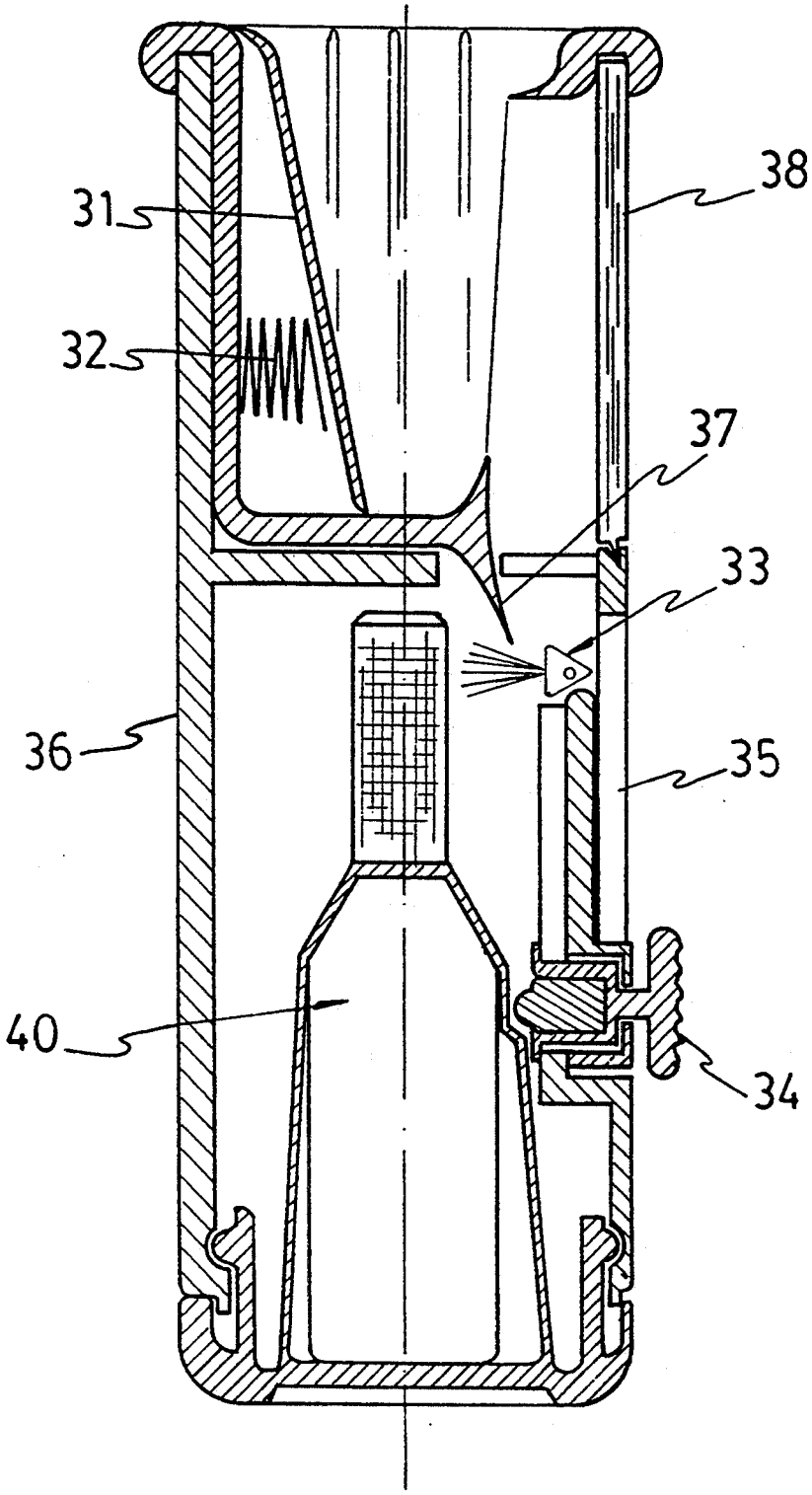
FIG. 12. Is a cross-split longitudinal elevation view of a nail varnish applicator operated by pressing a control button.
Figure 13:
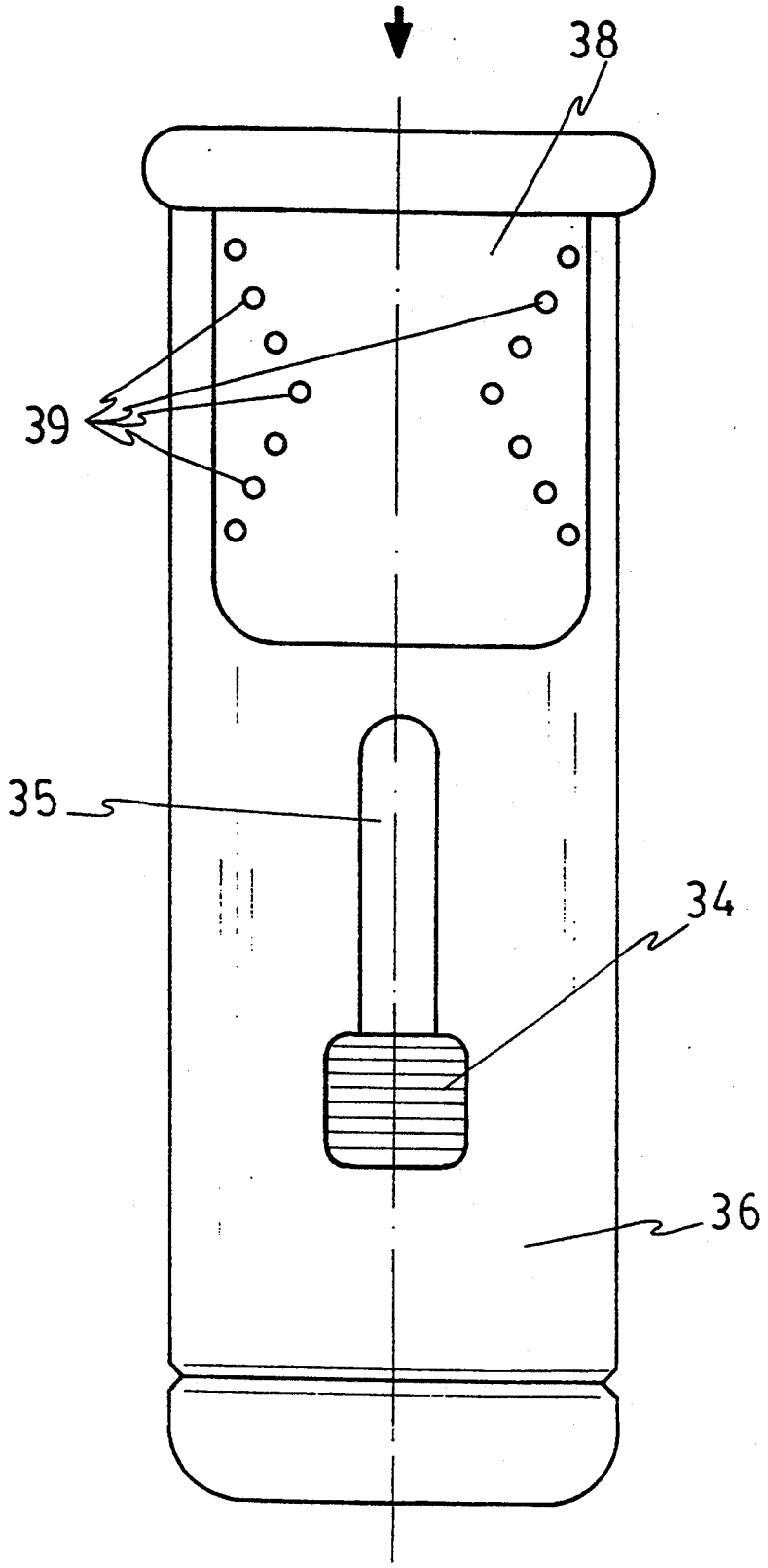
FIG. 13. Is a longitudinal elevation view of what is shown in FIG. 12.
Figure 14:
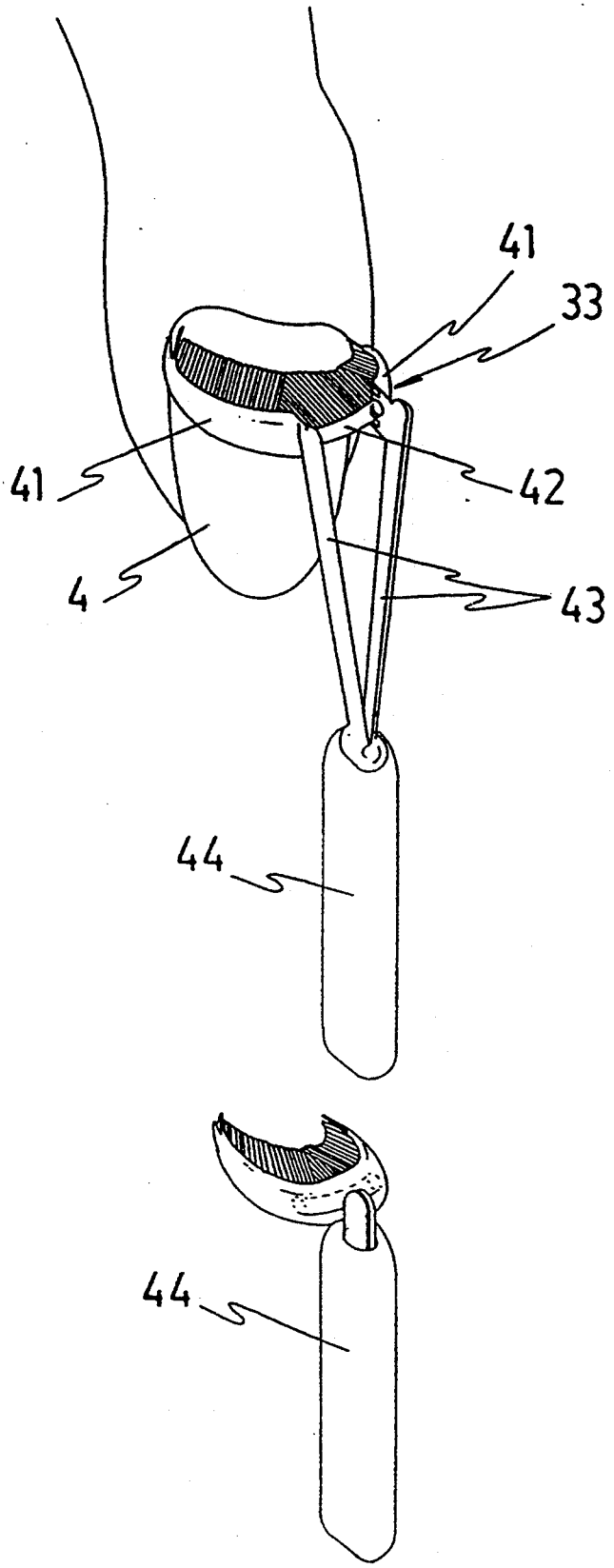
FIG. 14. Is a diagrammatic view showing the displacement and adjustment of the varnish applicator brush on the nail to be varnished.

FIGS. 12, 13 and 14 show a different embodiment of the varnish applicator, in a procedure whereby, on inserting the finger inside the body, a manual operation is necessary in order to displace the brush and for the latter to varnish the nail. The brush can therefore be displaced, while the nail remains in place in its housing within the body. The finger occupies a correct position since it is so obliged by a sloped sluice 31, which is fitted with a side actuation spring 32.

The brush 33 moves since it is fixed to the dispenser-push-button 34, that may slide along a longitudinal slot 35 in the body 36. The nail is correctly positioned and flanked by the pincers 37 that limit the nail contour, on inserting the finger and being obliged by sluice 31.

The position of the nail can be detected through a viewer provided at that area of the body, numbered 38.

As shown also in FIG. 12, the dispenser 40 can send the varnish, ejecting it towards the brush 33 bristles, instead of doing so through the tubular conduit defined by the handle thereof, as aforesaid.

FIG. 14 shows diagrammatically that the brush 33 has a back made up of two arched end elements 41 and an intermediate central element 42 that is inserted through the hole provided in the former. Each of these components 41 and 42 is provided with the relevant group of bristles, thereby to expedite adaptation of the active edge thereof to the nail 4 size. The end parts 41 extend into two arms 43 joined in V, which can be displaced inside the tubular body 44 to take up an open or closed position, with resilience at the apex area, as can be deduced from observing both positions in this FIG. 14.

What is claimed is

1. A fingernail varnish applicator, comprising:

a cylindrical body having one end shaped to connect to a source of nail varnish and an opposite end dimensioned to receive a user's finger;

a brush fitted with bristles with an adjustable spread for applying a dose of nail varnish from the source of nail varnish to a fingernail of the user's finger, the fingernail having a contour;

a pair of pincers positioned to contact the user's received finger, said pincers having a portion which compresses the spread of said bristles in accordance with the contour of the fingernail;

a hingeably mounted door for obstructing said opposite end of said cylindrical body;

a locking device for normally biasing said door to obstruct said opposite end of said cylindrical body, said locking device being released by the user's finger that is to be varnished;

a pumping device positioned to engage the user's received finger and mounted to move with the finger as it is inserted for advancing the dose of nail varnish to said bristles, said pumping device being coupled to said brush so as to orient said brush with respect to the user's received finger; and a casing for covering said bristles when the nail varnish applicator is not in use comprising one of a stub and a complementary helical slot and a displaceable casing having a hingeably mounted cap, said casing being displaced in response to the insertion of the user's finger by one of rotation and axial displacement, said casing returning to an undisplaced state in response to the withdrawal of the user's finger.

2. A fingernail varnish applicator as in claim 1, wherein said brush has an arched and resilient back portion, and said pincers include front edges which follow the fingernail contour as the user's finger is inserted into and removed from said body

3. A fingernail varnish applicator as in claim 2, wherein said pumping device further includes a spring biased axial rod and said locking device includes a double element push-button having a first and a second element, said first element being coupled to said door and being displaceable by force of the user's fingernail whereby said door is unlocked and said second element is engaged by the user's received finger which presses against said spring biased axial rod thereby displacing said spring biased axial rod and causing said pumping device to dispense the dose of nail varnish.

4. A fingernail varnish applicator as in claim 3, wherein said brush is shaped to guide the dose of nail varnish from said pumping device to said bristles, and wherein said pumping device includes a dispenser chamber intermediate said source of nail varnish and said brush for dispensing the dose of nail varnish to soak said bristles as the finger is inserted into said body, said dispenser chamber being replenished from said source of nail varnish by pump action of said axial rod when the finger is withdrawn from said body and said axial rod returns to an undisplaced state.

5. A fingernail varnish applicator as in claim 3, wherein each of said bristles has one end mounted radially in said arched and resilient back portion of said brush and has a curved free end, said arched and resilient back portion including several displaceable elements so that said bristles occupy more than a transverse plane and project from different displaceable elements thereby overlapping each other in part in order to sweep and adjust to the overall fingernail surface.

6. A nail varnish applicator as in claim 2, wherein said brush is shaped to guide the dose of nail varnish from said pumping device to said bristles, and wherein said pumping device includes a dispenser chamber intermediate said source of nail varnish and said brush for dispensing the dose of nail varnish to soak said bristles as the finger is inserted into said body, said dispenser chamber being replenished from said source of nail varnish by pump action of said axial rod when the finger is withdrawn from said body and said axial rod returns to an undisplaced state.

7. A nail varnish applicator as in claim 6, wherein each of said bristles has one end mounted radially in said arched and resilient back portion of said brush and has a curved free end, said arched and resilient back portion including several displaceable elements so that said bristles occupy more than a transverse plane and project from different displaceable elements thereby overlapping each other in part in order to sweep and adjust to the overall fingernail surface.

8. A fingernail varnish applicator as in claim 1, wherein each of said bristles has one end mounted radially in said arched and resilient back portion of said brush and has a curved free end, said arched and resilient back portion including several displaceable elements so that said bristles occupy more than a transverse plane and project from different displaceable elements thereby overlapping each other in part in order to sweep and adjust to the overall fingernail surface.

9. A fingernail varnish applicator, comprising:

a substantially cylindrical body having one end shaped to connect a source of nail varnish and another end dimensioned to receive a user's finger, said body having a longitudinal slot:

a brush having one end fitted with bristles with an adjustable spread for applying a dose of nail varnish from the source of nail varnish to a fingernail of the user's finger, the fingernail having a contour;

a push-button dispenser handle slideably mounted in said longitudinal slot and connected to said brush:

a pair of pincers positioned to contact the user's received finger, each of said pincers including a portion which compresses the spread of said bristles in response to the contour of the fingernail;

a sloped sluice biased so that the fingernail is obliged to be located on said pincers so that when said push-button dispenser handle is displaced in said longitudinal slot, said brush is displaced so as to varnish the inserted fingernail;

a view hole disposed above said sloped sluice;

at least one hingeably mounted door for obstructing said another end of said substantially cylindrical body; and a locking device for normally biasing said door to obstruct said another end of said substantially cylindrical body, said locking device being released by the user's finger that is to be varnished.

10. A fingernail varnish applicator as in claim 9, wherein each of said bristles has one end mounted radially in said arched and resilient back portion of said brush and has a curved free end, said arched and resilient back portion including several displaceable elements so that said bristles occupy more than a transverse plane and project from different displaceable elements thereby overlapping each other in part in order to sweep and adjust to the overall fingernail surface.

11. A fingernail varnish applicator, comprising:

a body shaped to connect to a source of nail varnish and dimensioned to receive a user's finger;

a brush having one end fitted with bristles with an adjustable spread for applying a dose of nail varnish from the source of nail varnish to a fingernail of the user's finger, the fingernail having a contour;

pincer means positioned to contact the user's received finger for compressing the spread of said bristles in accordance with the contour of the fingernail; and a covering means which is displaced by one of rotation and axial displacement when the user's finger is received and which is replaced when the user's finger is withdrawn for covering said bristles when the nail varnish applicator is not in use.

12. A fingernail varnish applicator as in claim 11, wherein said brush has an arched and resilient back portion, and said pincer means include front edges which follow the fingernail contour as the user's finger is inserted into and removed from said body.

13. A fingernail varnish applicator, comprising:

a body shaped to connect to a source of nail varnish and dimensioned to receive a user's finger;

a brush having one end fitted with bristles with an adjustable spread for applying a dose of nail varnish from the source of nail varnish to a fingernail of the user's finger, the fingernail having a contour;

pincer means positioned to contact the user's received finger for compressing the spread of said bristles in accordance with the contour of the fingernail;

pumping means for advancing the dose of nail varnish to said bristles, said pumping means being coupled to said brush so as to orient said brush with respect to the user's received finger;

a hingeably mounted door obstructing said opening for receiving a user's finger; and locking means for normally biasing said door to obstruct said opening for receiving a user's finger.

14. A fingernail varnish applicator as in claim 13, wherein said pumping means further includes a spring biased axial rod and said locking means includes a double element push-button having a first and a second element, said first element being coupled to said door and being displaceable by force of the user's fingernail whereby said door is unlocked and said second element is engaged by the user's received finger which presses against said spring biased axial rod thereby displacing said spring biased axial rod and causing said pumping means to dispense the dose of nail varnish.

15. A fingernail varnish applicator as in claim 14, wherein said brush includes means for guiding the dose of nail varnish from said pumping means to said bristles, and wherein said pumping means includes a means intermediate said source of nail varnish and said brush for dispensing the dose of nail varnish to soak said bristles as the finger is inserted into said body, said dispensing means being replenished from said source of nail varnish by pump action of said axial rod when the finger is withdrawn from said body and said axial rod returns to an undisplaced state.

* * * * *